US006676367B2

(12) United States Patent
Moss

(10) Patent No.: US 6,676,367 B2
(45) Date of Patent: Jan. 13, 2004

(54) REGENERATIVE PUMPS

(76) Inventor: Norman Moss, 22444 Van St., St Clair Shores, MI (US) 48081

( * ) Notice: Subject to any disclaimer, the term of this patent is extended or adjusted under 35 U.S.C. 154(b) by 0 days.

(21) Appl. No.: 09/981,864

(22) Filed: Oct. 18, 2001

(65) Prior Publication Data

US 2003/0077164 A1 Apr. 24, 2003

(51) Int. Cl.[7] ..... F04D 5/00

(52) U.S. Cl. ..... 415/55.1; 415/55.2; 415/55.3; 415/55.4; 415/55.5

(58) Field of Search ..... 415/173.1, 173.2, 415/173.3, 174.2, 148, 151, 167, 206, 55.2, 55.4, 55.5

(56) References Cited

U.S. PATENT DOCUMENTS 3,257,955 A * 6/1966 Worst ..... 415/55.4
4,948,344 A * 8/1990 Cygnor ..... 415/55.1
5,599,163 A * 2/1997 Heath et al. ..... 415/55.1

* cited by examiner

*Primary Examiner*—Edward K. Look
*Assistant Examiner*—Igor Kershteyn

(57) ABSTRACT

A regenerative fluid dynamic machine, typically a blower or compressor, includes an impeller (1) with fixedly attached blades (6) which may be radial or curved in a general convex fashion facing forward in the direction of turning. The impeller is enclosed in a housing which, together with the shaped profile of the rotor flank/s defines a toroidal passage (7) between inlet an outlet ports, fluid flow in said passage/s following a path which forms a spiral centred generally within the cross section of the passage, said housing may be provided with slideable side walls that are made to contact and expand the width of said toroidal passage to change the operation of the compressor so as to meet the requirements of fluid delivery or pressure. A preferred option is also proposed that will achieve a superior result through variations to the circumference span of the inlet passage.

16 Claims, 3 Drawing Sheets

OPERATION OF PUMP
AT ENGINE CRUISING SPEED

REGENERATIVE PUMPS

FIELD OF THE INVENTION

The present invention is directed to a regenerative pump, sometimes referred to as a peripheral pump, specifically designed for the automotive industry, for use in conjunction with automotive engines to function as an inlet air pressure booster, mainly when the engine delivers power in excess of what is required for cruise.

This pump will meet the needs of various acceleration and engine power at a given shaft speed of the pump, by changing the specific output of said pump. This objective and the means to achieve it will be clarified.

In another application that involves pumping liquid, a pump provided for the purpose of supplying lubrication oil to bearings of an automotive engine or an automotive transmission, may be advantageously created along the lines about to be described. With such a pump the increase in pressure normally experienced at higher engine speeds, may be avoided by an adjustment to the inlet porting or the size of the chamber. As a result, less driving power will be needed to drive the pump at high engine speeds.

The two uses mentioned above may be of particular interest, but there are other needs that may be met and satisfied in industrial and chemical fields.

BACKGROUND OF THE INVENTION

Commonly, these regenerative pumps are provided with an impeller having straight radial blades that terminate at their inner extremity into an arcuate wall that subtends generally a quadrant, and forms an inner portion of the fluid circulating chamber. Examples of these pumps may be obtained from U.S. Pat. Nos. 5,302,081, 5,205,707 and 5,163,810. There is also a related pump design that features what may be described as 'salient' vanes that project from a generally radial or wholly radial surface of the impeller. This is a feature that is opposed to the 'set in', or machined vanes of the usual design, that terminate at their inner extremity into an arcuate wall, that forms one of the inner quadrants of revolution, of the fluid chamber. Details of this version may be obtained from an ASME paper 76-WA/PID-22, authored by Sixsmith and Altman. The Sixsmith pump in utilizing the so called 'salient' vanes allows succeeding entry of circulating fluid to do so with little loss through a reasonable match of fluid and vane angles. This is a feature that cannot be accomplished with the aforementioned 'set in' vanes, and it explains why the older traditional designs have efficiency limited to 45% compared to a 'salient' vaned pumps efficiency of 58% or more. The superior vane entry conditions also confers a greater specific pressure and flow It should be explained that both of these pumps are provided with a surrounding casing that forms a closed, so called 'toroidal' chamber, that permits repeated entry of air or other fluid so that successive added pressure may be accumulated at each completed convolution. The chamber may be generally circular in a cross section cut along the axis of rotation, or it is sometimes has a radial cut section that is rectangular with rounded corners. This chamber traverses most of the circumference of the outer reaches of the pump but is interrupted by an inlet port and an outlet port, which are separated by a small region of close fitting section that envelops the vanes of the impeller, so termed the 'stripper' section. Another aspect of these pumps is that they may be single sided or double sided. It is here noted that the improvements about to be described pertaining to the pumps as just mentioned, apply to both single and double sided versions.

The present invention applies to all the above described pumps and seeks to confer similar benefits to all of them.

SUMMARY OF THE INVENTION

A close examination of the theoretical operation of this general type of pump has revealed that a relationship exists linking the number of convolutions of the fluid; the mean spiral flow path allowed by the sectional size of the toric chamber; the angle of fluid entering and leaving the vanes; and the circumferential span of the inlet and outlet porting.

Observation of the performance of pumps made in the past have shown that of the variables immediately listed above, the circumferential span of the inlet porting has a major influence on performance. Past observation has revealed that when the inlet passage is widened, the fluid flow correspondingly increases. The increase in flow is caused by an increase in the width of the convoluting fluid mass. It will also be understood that the number of convolutions will be correspondingly reduced. This will cause a decrease in the maximum pressure generated by the pump. It is found that the increase in flow will correspond broadly and directly to the width of the inlet port. The maximum pressure will fall in more or less the same proportion.

Now consider that the pump is working against a pneumatic or hydraulic load such that the operation point on the pumps pressure/flow characteristic occurs at the mid point at half the maximum pressure and half the maximum flow. (It will be appreciated that the broad operating characteristic of all these pumps follow a pattern defined by a line extending from a point of maximum pressure at zero flow to a point of zero pressure gain at maximum flow). In the case just defined, any change to inlet port size will not change the operation of the pump as the point of operation is in a neutral position. However, should the hydraulic or pneumatic load be chosen to occur at a flow exceeding the mid, or neutral region, just mentioned, the counter clockwise swing of the characteristic about the aforementioned neutral region, (as the inlet port increases in span), will cause a rise in pressure to occur.

It is an object of the present invention to provide pressure increases on demand when said pump rotates at any given speed. According to a first aspect of the present invention, in a regenerative pump, whether it may be provided with simple set-in vanes, or salient vanes protruding from an otherwise smooth surface of its impeller rotor, means are provided to permit variation of the circumference span of the inlet porting, such that when the operating point of the pump is chosen to be at a point beyond the mid point flow range, an increase in pressure will occur as the span of the inlet passage increases.

In a second aspect of the present invention, a pump as just described will be made to operate such that the operating point occurs at a flow below the so-called neutral or mid-region flow. In this aspect of the present invention, the same or similar means for varying the span of the inlet passage/s are provided, but conversely to the first aspect just described, the pressure increase will take place as the circumference span of the inlet passage is reduced.

According to a third aspect of the present invention, means are provided whereby the width of the chamber may he varied by providing an axially slideably outer wall or walls according to whether the pump is single or double sided. In a fourth aspect of the present invention, irrespective of where the operating point is chosen, means are provided whereby the inlet fluid passage may be varied such that the desired pressure may be generated as previously explained.

In all aspects that have just been described, means of pressure/flow variation may be applied to single or double chambers. In the case of double chambers, flow varying means may either be confined to one chamber or applied to both.

BRIEF DESCRIPTION OF THE DRAWINGS

FIGS. 2 and 3 are details of FIG. 1.

DESCRIPTION OF A FIRST EMBODIMENT

Figure 1:
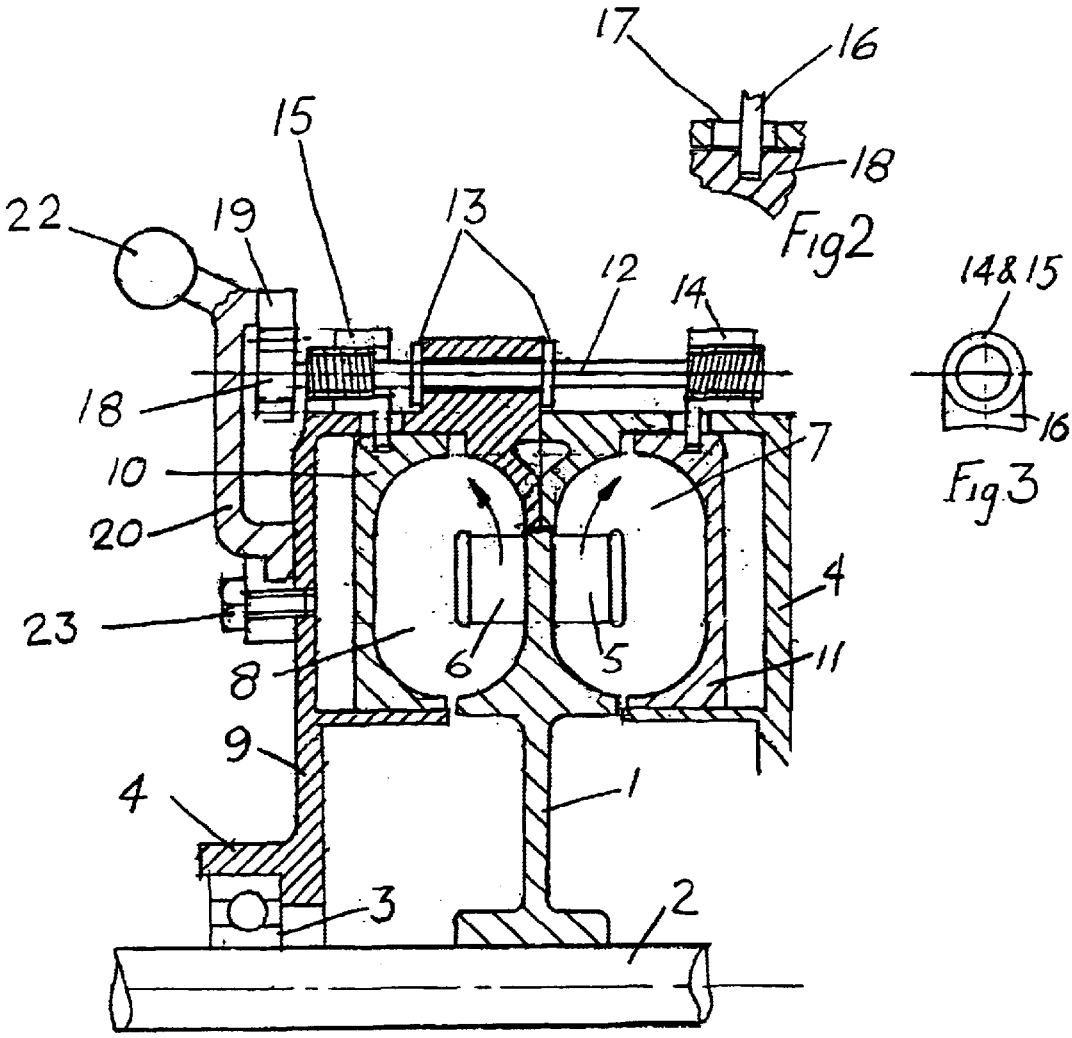
FIG. 1 is a cross-section of the regenerative pump according to the present invention.

Reference is made to FIG. 1. In this sketch, an impeller 1 mounted on a shaft 2, is suspended on bearings 3 set into a casing 4. The impeller carries two rows of salient blades 5 and 6 that protrude either side, which blades propel fluid radially outward relative to the turning axis of the shaft 2 and around chambers 7 and 8. Housing portions 4 and 9 are clamped together by bolts, not shown in this view, and each provides an inner and an outer axially cylindrical surface, which surfaces serve as guides for axial outer, profile defining fillets 10 and 11, which are slideably mounted so as to expand or contract the width of both toroids. The arrangements shown in the sketch provides means for adjusting the width of of the toroids simultaneously by means of shafts, 12 (one of which is shown), said shafts being axially restrained by sprung washers 13 that fit into grooves in the bolts, and having right handed and left handed screw threads provided to engage nuts 14 and 15. Said nuts being provided with a protruding extension 16 that passes through axial slots in the housing 17. The extensions 16 further, pass through holes or slots in the fillets 10 and 11.

It will be appreciated that when the shafts 12 turn, the nuts responsively slide, taking with them the fillets 10 and 11, which responsively, simultaneously contract or expand both fluid chambers. The sketch shows only one bolt, associated nuts and other features, but preferably there are three equally spaced such assemblies provided.

To provide rotary motion to shafts 12, pinions 18 are fixedly attached to one end, which pinions mesh with internally toothed ring 19. Ring 19 is fixedly attached to the plate 20 which is provided with supporting means that hold it in a radial alignment and closely against a radial surface of housing 4. In this embodiment, a guiding ring that is fixedly attached to housing 4 by means of screws 23 align plate 20 both axially and radially and allow it to freely rotate. Knob 22 or some other means to attach plate 20 to a control cable or linkage is also provided.

Figure 4:
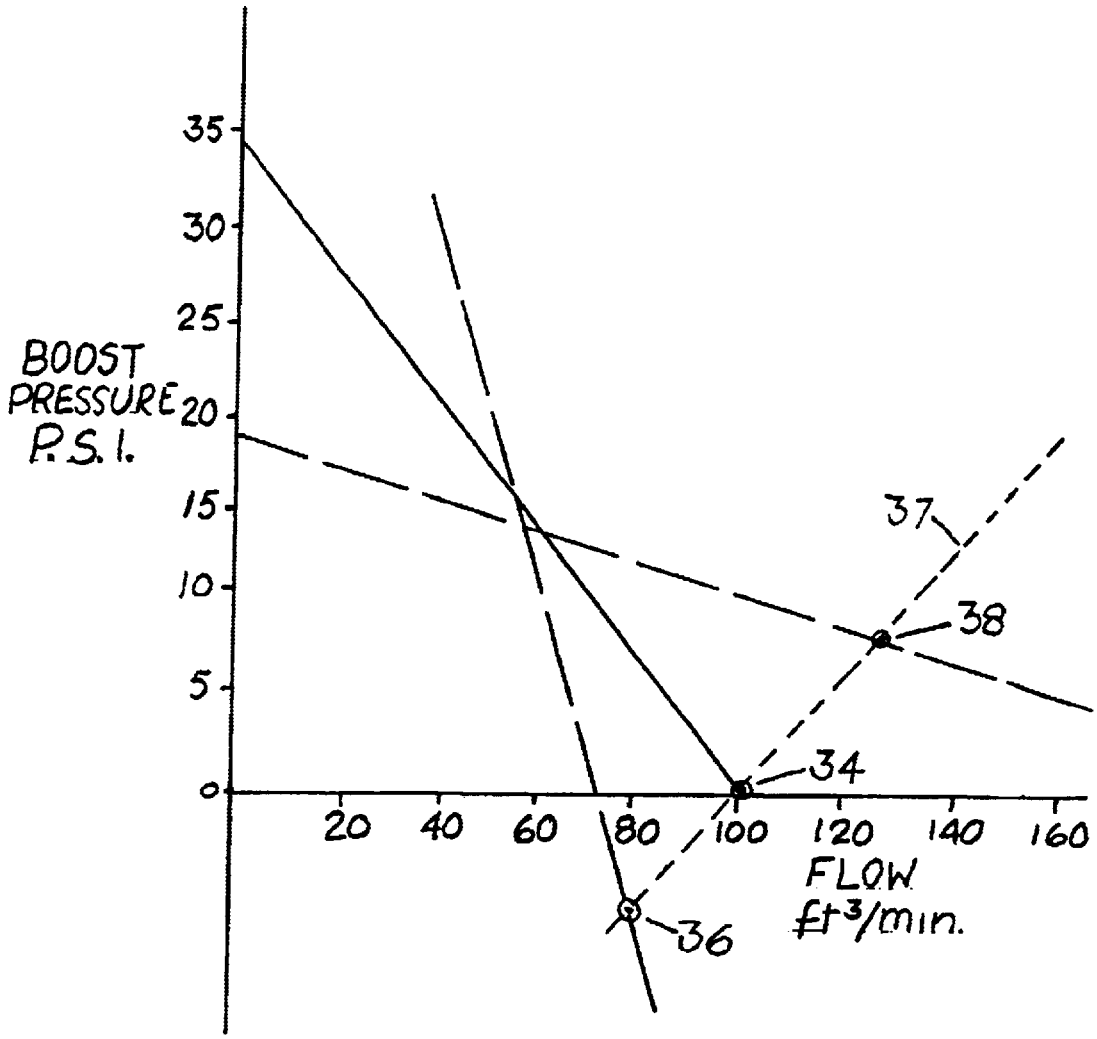
FIG. 4 is a graph of the operation of the regenerative pump at the engine cruising speed.

In order to explain the operation of the present invention reference will be made to FIG. 4 in addition to FIG. 1. FIG. 4 depicts the pressure/flow relationship that occurs at a constant shaft speed, but also at various geometric configurations that define specific flow and pressure according to the expansion or contraction of the toric chambers, caused by the axial displacement of the previously referred to, toric chamber defining fillets 10 and 11 as shown on FIG. 1. Point 34, which occurs at zero boost, where the unboosted engine power is sufficient to meet the requirements of cruising power of the vehicle, calls for a geometric configuration of the fillets such that will produce the operating line 38. When greater power is needed, they will be made to move outwardly, thereby expanding the chambers by various amounts according to the power requirements. Point 35 on FIG. 4 shows a boost of about 8 psi, and it is seen that it occurs at approximately 125 cubic feet per minute. The increase in flow from point 34 is caused by the increase in air density as the pressure of the air being forced into the cylinders of the engine rises. Point 36 occurs at a region below normal un-boosted cruise, and it can be seen that the pressure at this point has fallen below normal atmospheric level. When this happens, the engine torque driving the pump reverses in direction so that the pump, now performing the role of a turbine returns some positive power to the engine. The point just made serves to explain how this invention will obviate the need for a throttle not only above cruising power, but also below cruising power.

DESCRIPTION OF A SECOND EMBODIMENT

Figure 5:
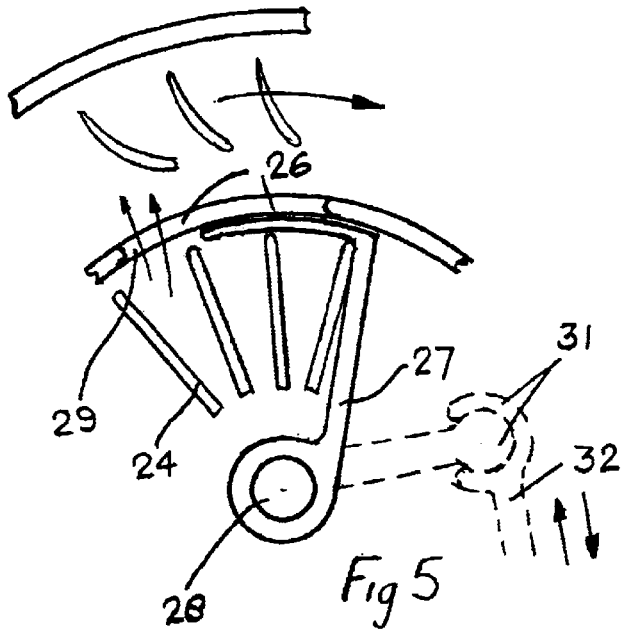
FIGS. 5–7 are illustrations of a second embodiments of the invention.
Figure 6:
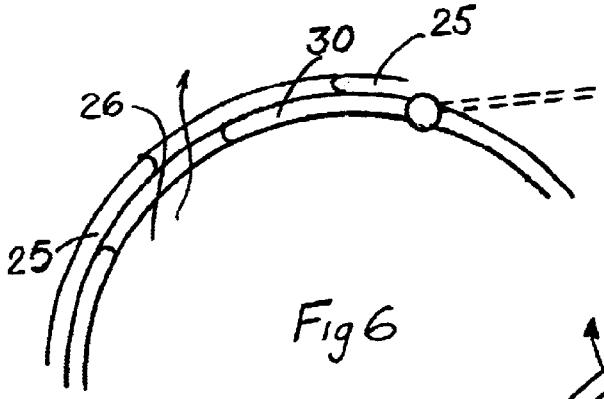
Figure 7:
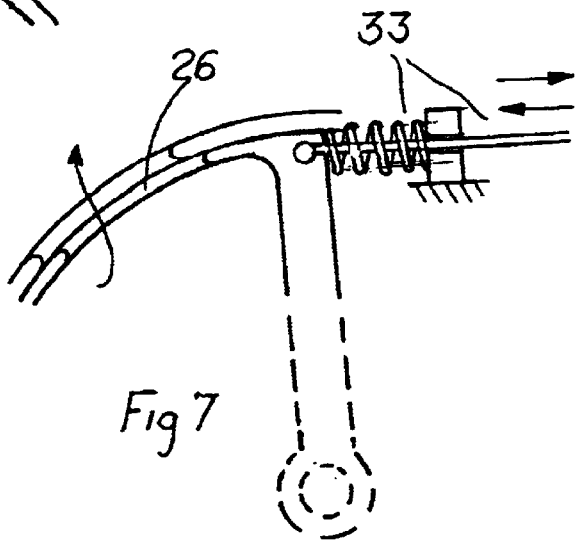

In another aspect of the present invention, reference is made to FIG. 5. It has been explained how the cross-sectional area of the toroid has a strong influence on the performance of this type of pump, generally increasing flow potential as it is expanded, by increasing the thickness of the convoluting stream, which reduces the number of re-circulations, therefore limiting the maximum pressure potential Experiments performed by the inventor of the present invention the past, also revealed that the span of the inlet aperture has a similar effect. As the span increases, the convoluting stream becomes wider, thus reducing the total number of convolutions. Conversely, as the span of the inlet aperture is made smaller, a greater number of thinner convolutions is produced. The sketch of FIG. 5 depicts a version of the present invention that includes a plurality of inner vanes 24. FIG. 5 shows a version of the present invention which portrays means adapted to vary the circumferential span of the inlet port 26. The sketch shows a control element 27 which is pivotably mounted and able to rotate about around a centre shaft 28. A portion of control element 27 is adapted to mask port 26 in varying degrees according to the angular position of the control element. It can be seen from the sketch that a clockwise movement will open the port by lessening the masking of aperture 26, and in so-doing opening aperture portion 29, and a counterclockwise movement will accordingly reduce aperture portion 29. Alternatively, the control element 30, is shown to extend circumferentially within and around a major span of wall 25. In this adaptation, the centre pivot will not be required. Means adapted to define any required position of control Element 27 or 30 such as the arm and socket 31 and cooperating push or pull rod 32, or a cable and spring arrangement connected to the accelerator pedal, shown as 33, will be included in the assembly.

Embodiments 1 and 2 made either be used to effectively control the specific flow of a regenerative pump but in some cases where, for instance, a relatively high variation in specific flow is required, the two alternative methods may be utilized in combination.

What is claimed is:

1. A regenerative pump for adding energy to a fluid by causing an increase in its pressure, and in the case where the fluid is compressible, an increase in its density;

an impeller having an axis of rotation, and axially spaced flanks that form a portion of a so termed toroidal or toric chamber on either side of said impeller;

a casing surrounding said impeller, which casing has a fluid inlet and a fluid outlet, separated by a stripper of a kind tat follows the practice as commonly provided in regenerative pumps;

an inlet for admitting air or fluid to the pump in a substantially radial direction, said inlet being positioned beneath the inner periphery of the blades and extending around a sector of the inner periphery.

2. A regenerative pump of claim 1 characterised by: a plurality of impeller blades that protrude from the flanks of the impeller in a broadly axial direction, said blades having an inlet portion at their inner radial extremity, and an outlet portion at their outer radial extremity.

3. A regenerative pump according to claim 1 or 2, wherein the said impeller blades extend axially to approximately one half or less of each, so called toric chambers total axial width.

4. A pump according to claim 3 where the impeller profile beneath the blades forms approximately a quadrant of the fluid chamber profile, terminating at its lowest extremity in a broadly axial direction.

5. A regenerative pump according to claim 4 wherein an axially extended projection or projections from the side or sides, respectively of the casing closely approach similar axially extending projections of the impeller thus providing a co-operative fluid seal to prevent the escape of fluid from the chambers.

6. A regenerative pump according to claim 1 provided with means adapted to vary the circumferential span of said inlet port opening in the casing.

7. The pump regenerative as described in claim 5 provided with with a control element that is pivotably mounted so as to permit its rotational adjustment about the axis of the pump, said control element closely sliding under the inner port-ion oft-he inlet port, such that the circumferential span of the port aperture may be varied according to the needs of the fluid supply.

8. The regenerative pump according to claim 7 wherein the aforementioned control element is circumferentially extended around and within a major portion of a closely fitting circumferential wall of the chamber such that a centrally positioned pivot is not required; said control element comprising a portion that slideably defines the opening span of said inlet aperture, and the major portion providing support for the control element.

9. A regenerative compressor according to claim 7 characterized in that the inlet span may be reduced sufficiently to cause a pressure drop across across said pump and in so-doing returns a portion of energy to the engine trough a reversal cute normal driving torque, via the belt and pulley or any other such means of mechanical rotational drive to the pump.

10. A regenerative compressor or pump according to claim 8 in which the inlet may be so reduced in area that there will be no need to supply a conventional engine throttle.

11. The pump according to claim 8 wherein there is provided a radially extending lever terminating in a ball or cylinder, said ball enveloped by a close fining socket which socket may be attached to a control cable or other such tackle provided to link the control aperture to an accelerating pedal in a vehicle, or link to other primary means of adjustment.

12. A pump according to claim 8 that includes a ball or cylinder fixedly attached to aforementioned control element, which ball or cylinder will facilitate means of attachment to a control cable, or other arranged elements provided to convey control to the fluid flow, density or pressure that the pump will deliver.

13. A pump according to claim 8 provided with an inner row of blades extending outwardly, and broadly radially from the surfaces of said impeller.

14. A pump according to claim 1 or 2 further comprising a single-sided chamber and vanes as opposed to the double-sided versions.

15. A pump according to claim 1 or 2, wherein the inner, leading edges of the primary impeller vanes have a forwardly facing (in the direction of rotation) inclination such that it has an angularity suitable to match the relative entry angle of fluid entering said vanes, so as to receive the fluid with least energy loss.

16. A pump according to claim 1 or 2, wherein the inner, leading edge of the primary impeller vanes have a profile that follows a so called aerofoil section of the type that is tolerant to fluid entering at an angle that does not exactly match the forward facing direction of the blades' leading edge. Such sections are relatively bulbous, compared with the sharp type of leading edge that appears in ASME paper 76-WA/PID-22.

* * * * *